US010233698B2

(12) United States Patent
Humphrey et al.

(10) Patent No.: US 10,233,698 B2
(45) Date of Patent: Mar. 19, 2019

(54) INSTRUMENTED ROTARY TOOLS WITH ATTACHED CUTTERS

(71) Applicant: SCHLUMBERGER TECHNOLOGY CORPORATION, Sugar Land, TX (US)

(72) Inventors: Caroline Humphrey, Cambridge (GB); John Cook, Cambridge (GB); Ashley Bernard Johnson, Cambridge (GB); Gokturk Tunc, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 123 days.

(21) Appl. No.: 14/906,567

(22) PCT Filed: Jul. 22, 2014

(86) PCT No.: PCT/IB2014/063306
§ 371 (c)(1),
(2) Date: Jan. 21, 2016

(87) PCT Pub. No.: WO2015/011643
PCT Pub. Date: Jan. 29, 2015

(65) Prior Publication Data

US 2016/0153244 A1 Jun. 2, 2016

(30) Foreign Application Priority Data

Jul. 22, 2013 (GB) ..... 1313046.3

(51) Int. Cl.
*E21B 10/56* (2006.01)
*E21B 12/02* (2006.01)
*E21B 47/06* (2012.01)

(52) U.S. Cl.
CPC ..... *E21B 12/02* (2013.01); *E21B 10/56* (2013.01); *E21B 47/065* (2013.01)

(58) Field of Classification Search
CPC ..... E21B 12/02
(Continued)

(56) References Cited

U.S. PATENT DOCUMENTS 2,457,960 A 1/1949 Walker
2,575,173 A 11/1951 Johnson
(Continued)

FOREIGN PATENT DOCUMENTS

CN 1464171 A1 12/2003
GB 2157342 A 10/1985
(Continued)

OTHER PUBLICATIONS

Chinese First Office Action for corresponding Chinese Application Serial No. 201480041718.3, dated Oct. 17, 2016, 12 pages, with English Translation.
(Continued)

*Primary Examiner* — David J Bagnell
*Assistant Examiner* — Brandon M Duck

(57) ABSTRACT

Wear sensors are provided on a drill bit or other rotary cutting tool which is for operation in a subterranean borehole and has a plurality of separate cutters protruding from a support structure towards the material to be cut by the tool. The electrically operated sensing means are located at or coupled to a sensing point within a protrusion from the support structure. This sensing point is located within a protrusion such that attrition of at least one cutter to a partially worn state brings the protrusion into abrasive contact with the material being cut and attrition of the protrusion then exposes the sensing point to the material which is being cut by the tool and thereby brings about a
(Continued)

detectable change, which may include damage to the sensor at the sensing point, indicative of wear. The tool includes means to communicate data from the sensing means to the surface.

17 Claims, 9 Drawing Sheets

(58) Field of Classification Search
USPC ..... 175/39
See application file for complete search history.

(56) References Cited

U.S. PATENT DOCUMENTS

| | | | | |
|---|---|---|---|---|
| 4,785,894 | A | 11/1988 | Davis, Jr. et al. | |
| 6,167,833 | B1 | 1/2001 | Caraway et al. | |
| 7,168,506 | B2 | 1/2007 | Boucher et al. | |
| 8,006,781 | B2 * | 8/2011 | Teodorescu | E21B 12/02 175/39 |
| 8,211,203 | B2 | 7/2012 | Sheng et al. | |
| 8,360,176 | B2 | 1/2013 | Zhang et al. | |
| 2006/0099885 | A1 | 5/2006 | Lynde et al. | |
| 2010/0139987 | A1 | 6/2010 | Hunt et al. | |
| 2011/0031017 | A1 | 2/2011 | Lwata et al. | |
| 2011/0266055 | A1 * | 11/2011 | DiGiovanni | E21B 10/08 175/50 |
| 2011/0283839 | A1 | 11/2011 | Teodorescu et al. | |
| 2012/0152617 | A1 | 6/2012 | Hunt et al. | |
| 2012/0255784 | A1 | 10/2012 | Hanford | |
| 2012/0325564 | A1 | 12/2012 | Vaughn et al. | |
| 2013/0008717 | A1 | 1/2013 | Deen | |
| 2015/0322720 | A1 * | 11/2015 | Pelletier | E21B 47/01 175/41 |

FOREIGN PATENT DOCUMENTS

| | | | |
|---|---|---|---|
| WO | 0235048 | A1 | 5/2002 |
| WO | 2013085869 | A1 | 6/2013 |

OTHER PUBLICATIONS

Chinese Second Office Action for corresponding Chinese Application Serial No. 201480041718.3, dated May 24, 2017, 12 pages, with English Translation.
Chinese Third Office Action for corresponding Chinese Application Serial No. 201480041718.3, dated Nov. 16, 2017, 10 pages, with English Translation.
European Search Report for corresponding European Application Serial No. 14828715.4, dated Jun. 29, 2016, 4 pages.
European Examination for corresponding European Application Serial No. 14828715.4, dated Aug. 9, 2016, 6 pages.
Combined Search and Examination Report for corresponding GB Application Serial No. GB1313046.3, dated Jan. 6, 2014, 6 pages.
GB Examination Report for corresponding GB Application Serial No. GB1313046.3, dated Jan. 11, 2018, 4 pages.
International Search Report and Written Opinion for corresponding PCT Application Serial No. PCT/IB2014/063306, dated Dec. 19, 2014, 14 pages.
Detournay, E., et al., "Drilling Response of Drag Bits: Theory and Experiment", International Journal of Rock Mechanics & Mining Sciences, vol. 45, (2008) pp. 1347-1360.
Rashidi, B. et al., "Real-Time Drill Bit Wear Prediction by Combining Rock Energy and Drilling Strength Concepts", Society of Petroleum Engineers, SPE 117109, (2008) 9 pages.

* cited by examiner

INSTRUMENTED ROTARY TOOLS WITH ATTACHED CUTTERS

BACKGROUND

There are a number of rotary cutting tools used to create, extend, enlarge or do other work within subterranean boreholes, which may be boreholes drilled in the course of oil and gas exploration and production. Drill bits are one instance of such tools. Others include reamers which are used to maintain or enlarge the diameter of a borehole and mills which are used to remove material which has been placed in a borehole. Such tools commonly have a support structure for cutting elements and separate cutters of hard material secured to the support structure. In some tools, the cutters are formed of hard material such as tungsten carbide or a mix of tungsten carbide and other material(s). In some tools, the cutters comprise a compact of polycrystalline diamond which may be supported on a body of other hard material such as tungsten carbide. Such cutters with polycrystalline diamond are commonly referred to as PDC cutters. When a tool has separate cutters of hard material (with or without polycrystalline diamond), the cutters are generally fabricated separately and subsequently attached to the support structure. This may be done by brazing.

During use of a cutting tool, its cutters undergo wear, which may be wear by abrasion, although chipping and breakage can also occur. Tripping a worn tool out of a borehole is time-consuming and therefore expensive. Tripping a tool out of a borehole before the amount of wear makes it necessary to do so is therefore a significant waste of resources. There are schemes for estimating wear of a drill bit from surface or downhole parameters such as rate of penetration, torque, rotary speed and weight on the tool. One such scheme for predicting wear comes from work of Detournay et al in "Drilling response of drag bits: theory and experiment" International Journal of Rock Mechanics and Mining Sciences vol 45 pp 1347-1360 (2008) and another from Rashidi et al in "Real-Time Drill Bit Wear Prediction by Combining Rock Energy and Drilling Strength Concepts" Society of Petroleum Engineers paper SPE 117109.

Cutting tools such as drill bits may incorporate sensors of various types. The information collected from such sensors whilst the drill bit is in use may be stored in electronic memory accommodated within the cutting tool itself and/or may be transmitted to the surface. U.S. Pat. No. 7,168,506 shows a drill bit which is provided with a number of sensors. Several kinds of sensors are mentioned in this document including wear sensors. U.S. Pat. No. 8,006,781 discloses a drill bit in which sensors intended to detect wear may be constructed to carry an electrical signal current whilst intact and to be destroyed by wear, so that the wear can be revealed by the circuit ceasing to carry the signal current. In U.S. Pat. No. 8,006,781, the wiring to detect wear extends within the body of the drill bit beneath the hard cutters.

SUMMARY

This summary is provided to introduce a selection of concepts that are further described below. This summary is not intended to be used as an aid in limiting the scope of the subject matter claimed.

Disclosed herein is a rotary cutting tool which is to be used in a subterranean borehole and which comprises a support structure and a plurality of cutters secured to the support structure. The cutters project from the support structure towards the material to be cut by the tool. The tool has electrically operated sensing means at or coupled to a sensing point within an element protruding from the support structure, wherein the sensing point is located such that attrition of at least one cutter to a predetermined partially worn state exposes the sensing point to the material which is being cut by the tool and thereby brings about a change in condition at the sensing point. The sensing means is operative to detect the change at the sensing point, and the tool includes means to communicate data from the sensing means to the surface.

The element protruding from the support structure which contains the sensing point may be one of the cutters. As the cutter is worn down through abrasion or possibly through chipping or breakage by the material which is being cut, the attrition of material from the cutter eventually reaches the sensing point and exposes it to the material which is being cut.

Another possibility is that the protruding element is not itself a cutter but is a separate protrusion which projects (as the cutters do) from the support structure towards the material to be cut by the tool, but dimensioned to travel within hole cut by at least one of the cutters of the tool so as to be shielded from abrasive contact with the material to be cut by the tool until abrasive wear of the at least one cutter reduces its size and brings the protrusion into abrasive contact with the material to be cut by the tool. Attrition of the cutters will continue as the tool is used and will be accompanied by attrition of the protrusion until a predetermined point is reached when the cutters are worn, although only partially worn, and the sensing point is exposed to the material being cut. This brings about the detectable change at the sensing point. A protrusion which is separate from the cutters may be directly adjacent to a cutter or may be spaced from a cutter or cutters which initially shield the protrusion from contact with the material to be cut.

Although concepts disclosed here could be implemented with a single sensing point, some embodiments have a plurality of sensing points in a plurality of protrusions from the support structure. A plurality of protrusions may be distributed over the cutting surface of the rotary cutting tool so that it is possible to monitor wear at a number of points. It is also possible that more than one sensing point is provided in an individual protrusion, arranged so that one sensing point is exposed after a certain amount of attrition and another sensing point is exposed later, after a greater amount of attrition of a cutter or cutters.

Electrically operated sensing means may take a number of forms and may include a sensor at the sensing point which is operated by electrical circuitry located elsewhere. In some embodiments, sensing means may comprise a signal carrying line, which may be an electrical conductor or an optical fibre so as to carry electric current or a light signal along a defined path leading to the sensing point. A signal carrying line or lines may lead to a sensor at the sensing point or may themselves constitute at least part of a sensor for a condition at the sensing point. Such a signal carrying line may provide a sensor which is sacrificial in that when the sensing point becomes exposed by abrasive wear, the sensor is broken or damaged by contact with the material which is being cut and then ceases to function as it did previously.

It will be appreciated that such arrangements detect change at the sensing point by giving a negative result. The sensor will function and can give a positive indication or value (for example when interrogated by software) until the sensing point is exposed and the signal carrying line is broken or damaged so that it ceases to operate, which is a negative indication or value. A signal carrying line or lines may connect to a sensor for a physical property, such as temperature, within the protrusion so as to provide a measurement of this property while the sensor is intact before the sensing point is exposed.

The sensing means may comprise electronic circuitry to send signals along a line or lines which lead to and from the sensing point or which constitute at least part of a sensor at the sensing point. If a signal carrying line is an optical fibre, the electronic circuitry may comprise a light source and a light detector.

A yet further possibility is that the sensing means may comprise a cavity extending within the tool to the sensing point and the sensing means could operate to detect opaque drilling fluid flowing into this cavity when the sensing point is exposed. In such an arrangement, the cavity serves as a signal path between the sensing point and a sensor for detecting fluid entering the cavity.

The rotary cutting tool may come within any of several categories. One is drill bits which are mainly, if not exclusively, used for drilling through subterranean rock formations. This category includes standard drill bits, core bits, eccentric bits and bicenter bits, all of which may be constructed with separate cutters attached to a fixed support structure which is the main body of the drill bit. A drill bit may also have cutters on a support structure which moves relative to a main body of the bit, as is the case with roller cone bits.

The body of a drill bit, constituting a support structure for cutters, may be made of steel or may be made of a hard material such as a matrix of tungsten carbide particles infiltrated by a metallic binder.

Another category of cutting tool is reamers and under-reamers used to maintain or enlarge the diameter of a portion of a borehole. A reamer has a body, which may be steel, with cutters projecting radially outwardly from a tool axis towards the wall of a borehole and is used to ensure that the borehole continues to have the diameter through which the reamer has already descended. Such a reamer may be located in a bottom hole assembly above a drill bit and serve to enlarge the diameter already drilled by the drill bit, or ensure that the drill bit has achieved the intended diameter by removing material from any point where the intended diameter has not already been achieved. An under-reamer has parts which can be expanded outwardly from the body and which are the supporting structures for cutters which project radially outwardly towards a borehole wall. Because these parts are expandable, an under-reamer can be used to enlarge a portion of a borehole to a diameter which is greater than the diameter of the hole further above it. The body and expandable parts may be made of steel.

Milling tools are used for cutting through structures which are present in the borehole. Such structures may have been placed in the borehole as a deliberate but temporary blockage, such as a cemented packer, or may be an accidental obstruction in a borehole. Some milling tools have cutters at the downhole end of the tool so that they are akin to drill bits. Other milling tools have cutters on structures which project towards a borehole wall, somewhat akin to reamers and these support structures may be expandable.

The cutters which are attached to support structures in rotary cutting tools as discussed above may be PDC cutters. These may have a cylindrical body with a polycrystalline diamond section at one end. The body may be moulded from hard material which may be tungsten carbide particles infiltrated with metallic binder. The polycrystalline diamond section may then comprise particles of diamond and a binder. In many instances, the polycrystalline diamond section is a disc so that the hardest end of a cutter is a flat face before any wear takes place. However, this is not always the case: cutters may be made with a polycrystalline diamond section which tapers to a point or which has some other shape.

Cutters are not always PDC cutters and are not always cylindrical. Cutters may, for example, be manufactured entirely from a single composition comprising tungsten carbide particles and binder (possibly also including some other metal carbide particles). Cutters of this type may be favoured as the cutters used on milling tools or on portions of milling tools because they are better able to withstand temperatures reached when cutting steel.

Although it is mentioned above that cutters may be secured to a supporting structure by brazing, which may secure a cutter with no possibility of movement relative to the support structure, WO2013/085869 discloses a drill bit with cutters attached to it such that a cutter can rotate about its own axis, thereby distributing wear around the edge of the polycrystalline diamond disc which contacts the formation. The sensing means and protrusions disclosed herein may be used in conjunction with cutters secured in this way.

In a second aspect of the present disclosure, a rotary cutting tool has sensing means for a property or condition at a plurality of sensing points distributed on a cutting tool, for instance at radially inner and radially outer positions on a drill bit, and the pattern of observations at the sensing points provides evidence that the cutting tool is or is not operating in the manner intended. More specifically, an abnormal pattern of a measured physical property or an abnormal pattern of wear may indicate abnormal motion of the cutting tool, such as a whirling motion in which a drill bit moves bodily in a circle, as well as rotating about its own axis.

The present subject matter can also be stated as methods. Thus in a further aspect there is here disclosed a method of monitoring the condition of a rotary cutting tool operating in a subterranean borehole, the tool comprising a support structure and a plurality of separate cutters attached to the support structure and protruding from the support structure towards the material to be cut by the tool, wherein the method comprises providing the tool with electrically operated sensing means at or coupled to a sensing point within a protrusion from the support structure, wherein the sensing point is located such that attrition of at least one cutter to a predetermined partially worn state exposes the sensing point to the material which is being cut by the tool and thereby brings about a change in condition at the sensing point, operating the sensing means to sense the condition at the sensing point, and communicating sensed information to the surface.

DETAILED DESCRIPTION

Figure 1:
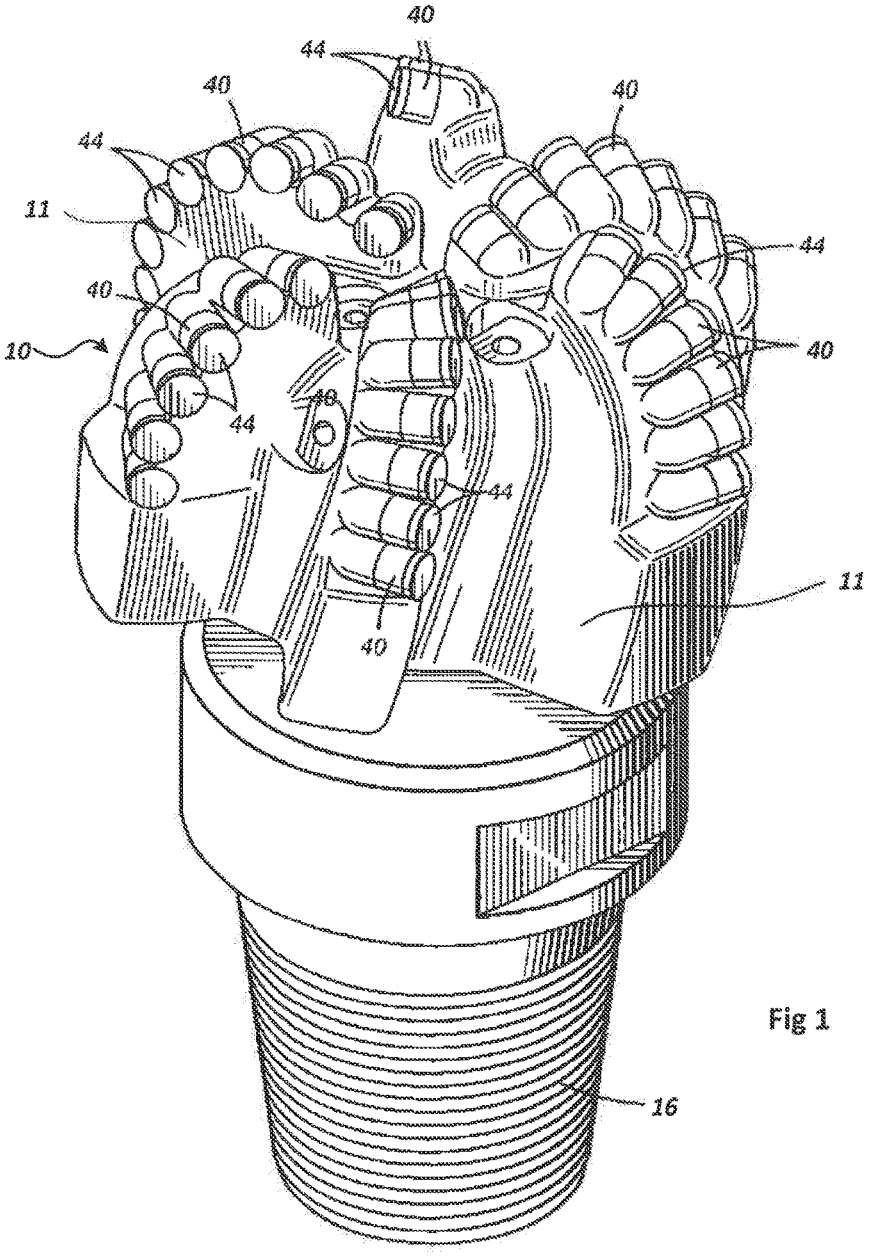
FIGS. 1 and 2 are a perspective view and an end on-view which both show a general arrangement of a conventional fixed cutter drill bit.
Figure 2:
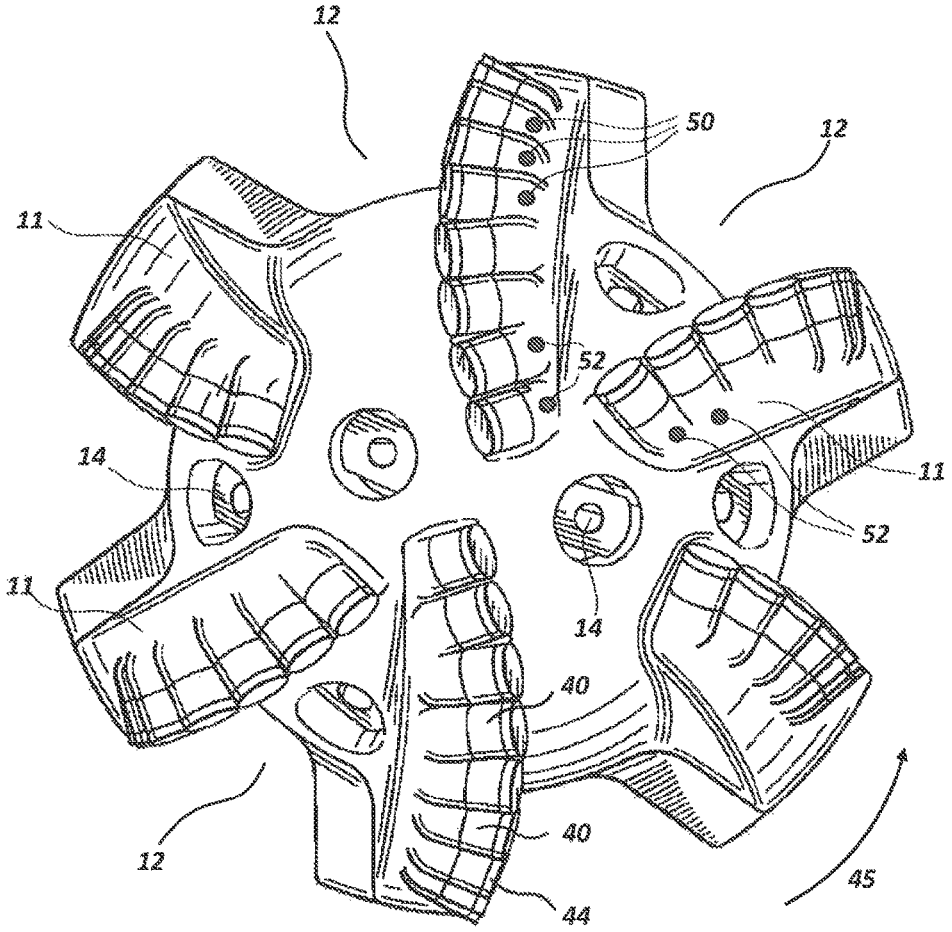

FIGS. 1 and 2 show by way of illustrative example the general form of a conventional fixed cutter drill bit which may be used for drilling a subterranean wellbore. The main body 10 of the drill bit is connected to a screw thread 16 at one end for attachment to a drill string. The main body includes projecting portions, referred to as blades 11, separated by channels 12. The body and more specifically the blades 11 provide a support structure for rows of cutters 40 which in this example are PDC cutters. The main body includes internal passages for drilling fluid supplied down the drill string to exit through outlets 14 and then flow along the channels 12 between the blades 11. Flow of drilling fluid cools the drill bit and carries away the drilling cuttings.

Drill bit bodies may be made from a number of materials, but it is common for them to be formed from a particulate hard material such as tungsten carbide which is packed into a mould and infiltrated with molten metal binder. An example of a disclosure relating to matrix materials for drill bits is U.S. Pat. No. 8,211,203. The drill bit shown here in FIGS. 1 and 2 may have a body which is formed in this way from a matrix of tungsten carbide particles. When moulding a drill bit body in this way the mould may be made from graphite. Interior pathways within the drill bit may be created by placing graphite rods within the cavity defined by the mould and then packing the granular material around such rods.

Each of the PDC cutters 40 may be of a conventional construction in which the cutter is a cylinder of hard material such as tungsten carbide matrix and has a disk 44 formed of polycrystalline diamond on one end face. The blades 11 of the body 10 are moulded with recesses to receive the PDC cutters 40. The cutters 40 are secured into these recesses by a brazing process and an example of a disclosure of such a process is provided by U.S. Pat. No. 8,360,176. The PDC cutters 40 are attached to the blades 11 in positions such that they face forward in the direction of rotation of the drill bit, indicated by arrow 45 in FIG. 2 but also protrude from the blades 11 so that the diamond disks 44 contact the formation as drilling takes place.

Figure 3:
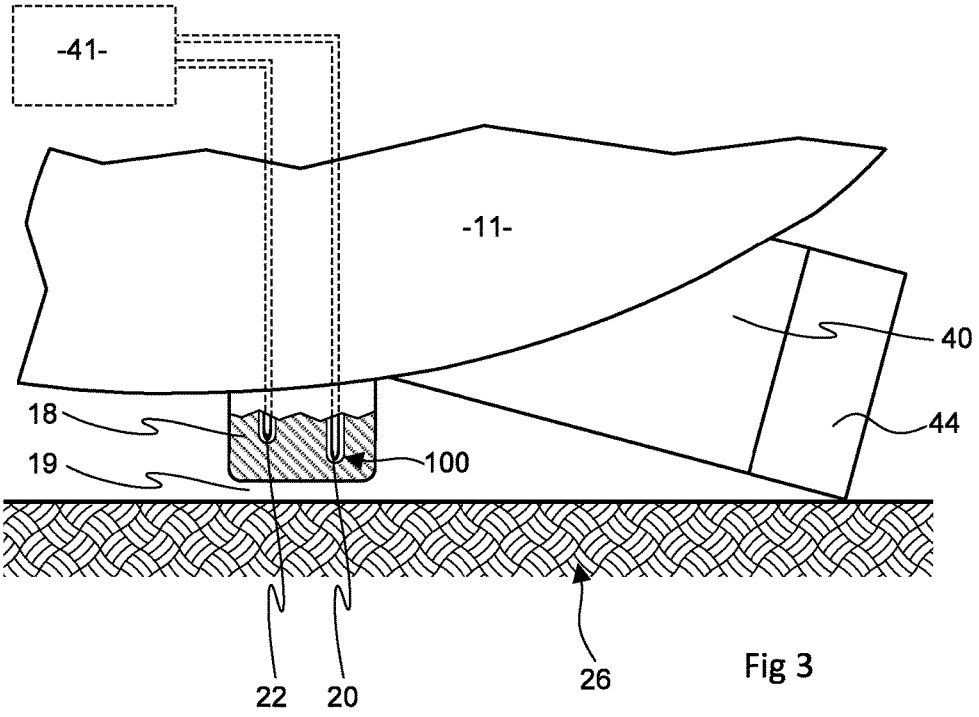
FIG. 3 is a detail view along the blade of a drill bit showing a PDC cutter and provision of sensors in a protrusion.

FIG. 3 is a detail view of part of a fixed cutter drill bit embodying the invention. This drill bit is constructed generally as shown in FIGS. 1 and 2 but is provided with a number of protrusions enclosing wear sensors. One PDC cutter 40 is seen in FIG. 3: as can be seen, it projects from the blade 11 at an angle and its diamond disk 44 contacts the formation 26 while the blade 11 remains spaced from the formation. Sensors 20, 22 are located in a protrusion 18 from the blade 11. The protrusion 18 may be made from the same material as the body 10 and may be formed integral with the body 10 when the body is made by moulding from a particulate matrix material. However, it is also possible that a protrusion could be made separately and then attached to the body of the drill bit, possibly by brazing as is used for the attachment of cutters.

Figure 4:
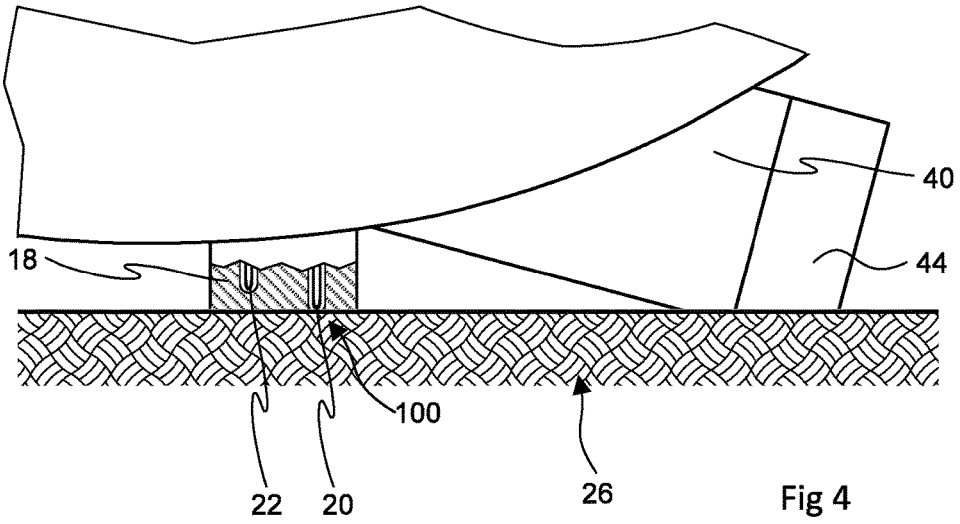
FIG. 4 is a similar view to FIG. 3 showing the same parts after some wear.

The protrusion 18 is separate from the cutter 40 and is positioned so that it follows behind the PDC cutter 40 as the drill bit is rotated. The protrusion 18 has dimensions such that when the drill bit is new and unworn, the protrusion 18 does not contact the formation 26. As seen in FIG. 3 there is a space 19 between the protrusion 18 and the formation 26. However, when the cutter 40 has been partially worn down through use, as shown in FIG. 4, the protrusion 18 does come into contact with the formation 26 and is itself subjected to abrasive wear.

Figure 5:
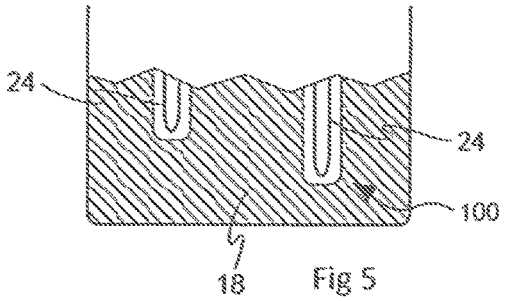
FIG. 5 is an enlarged view of the protrusion of FIG. 3.

As shown by the enlarged view in FIG. 5, a sensor within each protrusion 18 is a wire 24 formed into a U-shape and coated with a refractory electrically insulating material such as alumina. Application of a refractory insulation may be carried out by a vapour deposition process. A number of physical and chemical vapour deposition processes are known including plasma enhanced chemical vapour deposition, which may be used for the application of alumina or silica.

The dimensions of the protrusion 18 and the position of the sensor wire 24 within the protrusion 18 are chosen such that when the PDC cutter 40 and the protrusion 18 have both worn away by a predetermined amount, the tip of the U-shaped wire 24 becomes exposed and is worn through, so that the electrical continuity through the wire is lost. This event can be detected easily by electronic circuitry. An electronics package, diagrammatically indicated at 41 in FIG. 3, may be accommodated within a cavity provided within the body of the drill bit and can provide circuitry to pass current through the wire 24 and detect when continuity through the wire 24 is lost. The electronics package can also operate the communication of measured data to the surface. A number of techniques for communication up and down a wellbore are known. Possibilities for the communication could be telemetry such as that used by downhole measurement while drilling (MWD) or logging while drilling (LWD) tools. Telemetry channels could be one or a combination of mud pulse telemetry through the drilling fluid, electromagnetic telemetry through the borehole wall and the earth around the wellbore, a fibre optic line going to the surface, and wired drill pipe.

The sensor 22 is constructed similarly to the sensor 20, but is positioned further from the extremity of the protrusion 18 so that it remains intact until a greater amount of wear has taken place.

It will be appreciated that by locating the sensing point 100 in a protrusion from the support structure which is the blade 11 of the drill bit, it is possible to detect partial wear of a cutter 40 while part of the cutter remains intact. This is achieved without modification of the cutter and without modification of the process for attachment of the cutter to the body of the cutting tool.

Figure 6:
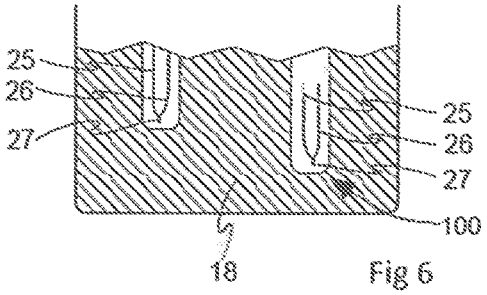
FIGS. 6 to 9 are similar views to FIG. 5 showing different types of sensor within a protrusion.
Figure 7:
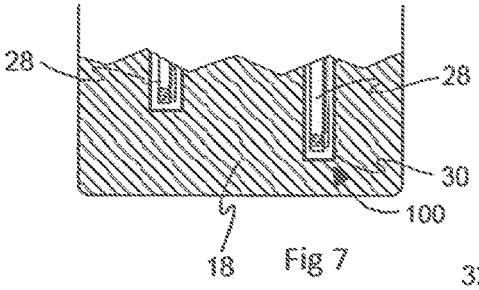

There are a number of other possibilities for construction of the sensors. In place of plain wire 24, FIG. 6 illustrates a sensor which is formed from two wires 25, 26 of dissimilar metals joined at the tip 27 of the U-shape so that the connection between them is one junction of a thermocouple. FIG. 7 shows another possibility in which each sensor is a platinum resistance thermometer comprising a coil of this platinum wire wound around a ceramic former 28 and enclosed within a housing 30. Sensors as shown in FIGS. 6 and 7 could be used to estimate the temperature within the protuberance 18 up until the moment when the sensor is destroyed through wear and would be expected to show an increase in temperature shortly before the sensor is destroyed.

Another possibility is to make a sensor using an optical fibre to convey an optical signal. Electronic circuitry would then operate a light source to transmit an optical signal along the fibre and a light receiver such as a photodiode would be used to detect the optical signal coming from the sensing point.

Figure 8:
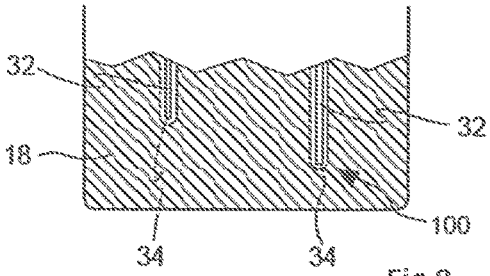

An optical fibre could extend in a loop like the wire 24, but as shown in FIG. 8 an optical fibre 32 may lead to a reflective coating at its end 34. So long as the end 34 of the fibre is intact, a substantial proportion of the light signal along the fibre is reflected back by this coating and can be detected, for example by a photodiode. When the end 34 of the fibre is worn away and the reflective coating is lost, the amplitude of the reflected signal drops sharply and so destruction of the sensor can be detected as a drop in amplitude of the reflected optical signal.

Figure 9:
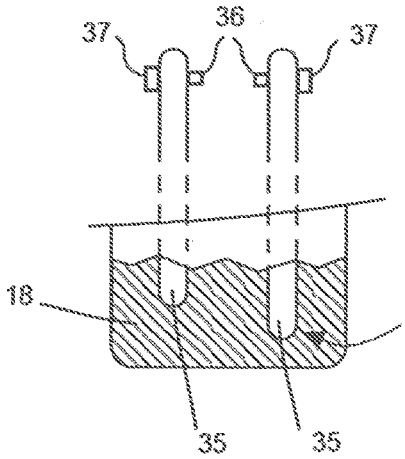

FIG. 9 shows yet another possibility. A sensing point 100 within the protrusion is provided by one end of a closed tube 35 leading to a detection point within the drill bit. At the detection point a light source 36 illuminates a photodiode 37. Wearing down of the protrusion 18 eventually breaks into the closed tube 35, allowing the opaque drilling mud to enter the tube 35 and block the light path from source 36 to photodiode 37.

Figure 10:
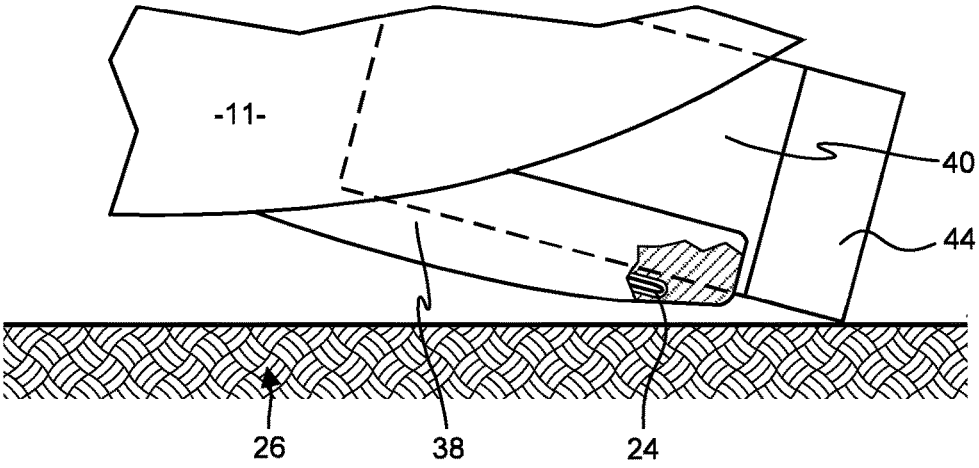
FIG. 10 is a detail view similar to FIG. 3 showing a sensor in a protrusion located alongside a PDC cutter.

FIG. 10 is analogous to FIG. 3 but shows a different constructional arrangement which would achieve a similar function. The sensor wire 24 is located in a protrusion 38 which is immediately adjacent to the cylindrical body of a PDC cutter 40 and is contiguous with the recess in blade 11 into which the PDC cutter is secured.

Figure 11:
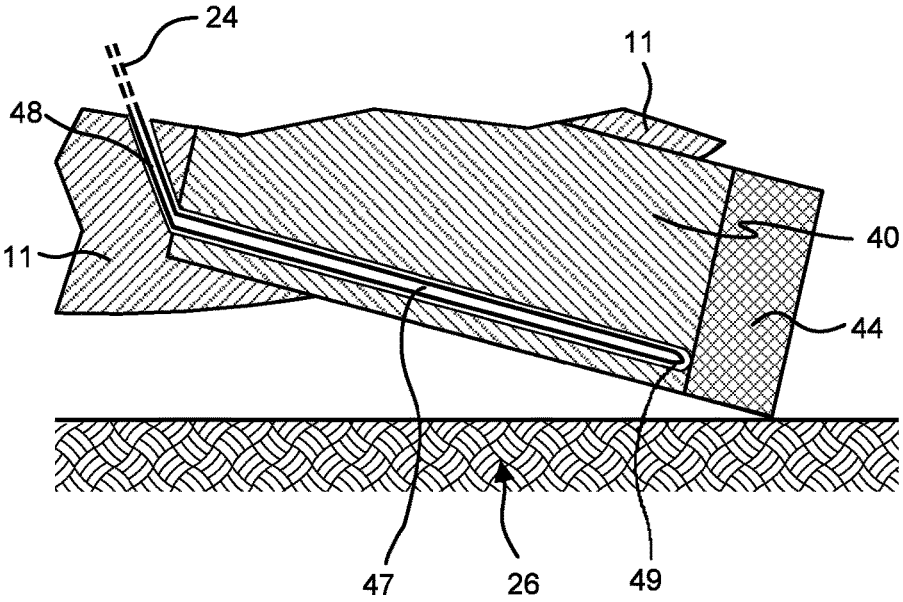
FIG. 11 is a detail view akin to FIG. 3 but showing the blade of a drill bit and a cutter in section, and a sensor in the cutter.

FIG. 11 shows a further arrangement. The blade 11 and cutter 40 are shown in cross-section. The body of the cutter 40 is manufactured with a cylindrical hole 47 extending axially through it up to, but not into, the polycrystalline diamond disc 44. This hole 47 may be formed by moulding the body of the cutter around a graphite rod which is then subsequently removed, or by electrochemical machining of the cutter body 40 after it has been manufactured. The blade 11 of the body of the drill bit is manufactured with a passageway 48 extending through it. The cutter 40 is secured to the blade 11 by brazing with the cutter 40 oriented so that the hole 47 aligns with the passageway 48 and connects to it. If the passageway 48 or hole 47 becomes obstructed with brazing metal during this step, the obstruction can be removed with a flexible drill inserted through passageway 48.

An insulated wire 24 bent into a U-shape is then inserted through the passageway 48 and hole 47 to the position shown so that the tip 49 of the wire 24 provides a sensor at a sensing point 100 behind the diamond disc 44. When abrasive wear of the cutter breaks into the hole 47, the wire 24 is broken at its tip 49 and ceases to conduct. Instead of the wire 24 as a sensor it would be possible to use an optical fibre, a thermocouple or a resistance thermometer as a sensor inserted within hole 47 analogously to their use in separate protrusions as described above with reference to FIGS. 6 to 8. It would also be possible to use an arrangement analogous to that in FIG. 9 so that when wear exposes the hole 47, drilling fluid flows into the hole 47 and pathway 48 and is detected within the drill bit.

Sensors may be located behind a number of PDC cutters on a cutting tool so as to observe the pattern of wear over the drill bit. Moreover, observation of the pattern of wear may reveal abnormal motion of a drill bit or other cutting tool. This is illustrated with reference to FIG. 2 which shows that protrusions with sensors in them may be provided at radially outer positions indicated by circles 50 and radially inner positions indicated as 52.

Detection of wear at the positions 50, which are located outwardly from the centre of the drill bit, is indicative that abrasive wear of the radially outer cutters has taken place, which is to be expected in normal operation of a drill bit. Wear at positions 50 would normally be accompanied by detection of wear at the radially inner positions 52.

However, if sensors at positions 52-cease to operate, apparently indicating wear at these positions, without wear at the positions 50, it is likely that the drill bit is in the condition referred to as whirling, in which the drill bit moves bodily in a circle as well as rotating around its own axis as intended. Such whirling would wear the radially inner protrusions more rapidly than in normal operation and might also damage them through impact rather than abrasion.

Figure 12:
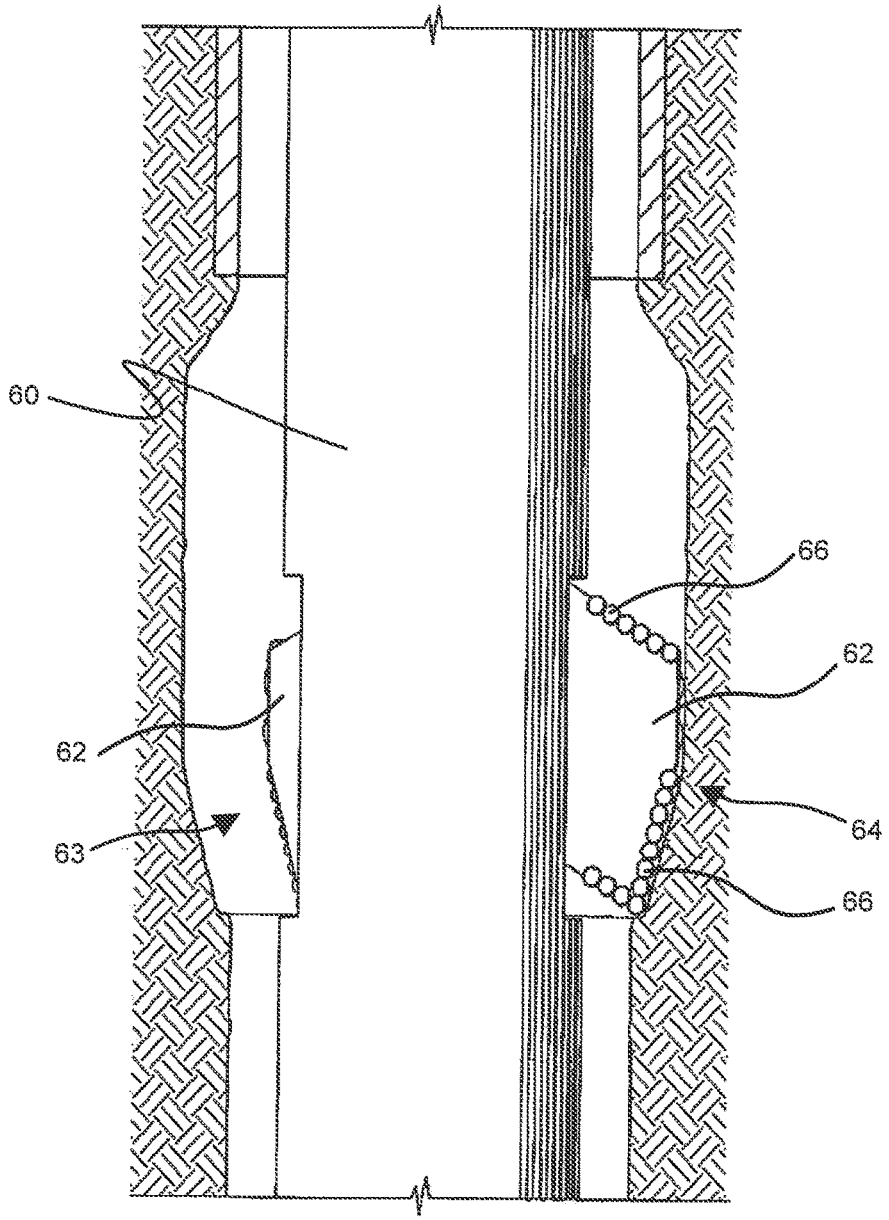
FIG. 12 shows a reaming tool.
Figure 13:
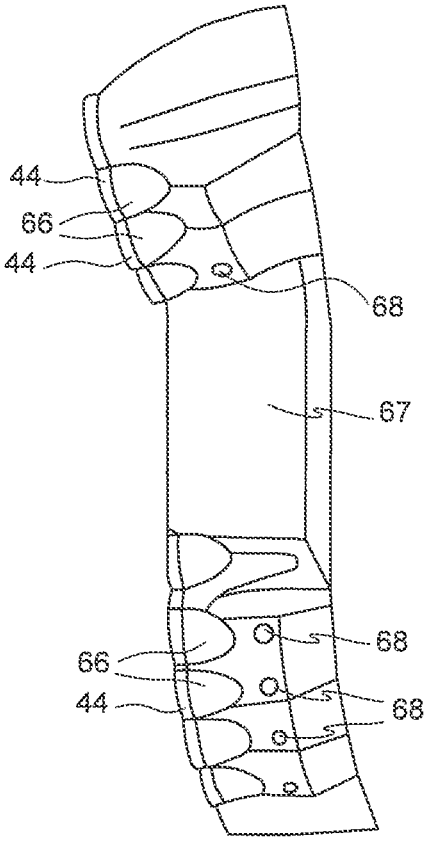
FIG. 13 is a view onto an extendable arm of the tool of FIG. 12.

FIGS. 12 and 13 show an under-reamer which may be provided with sensors in an embodiment of the concept disclosed here. The under-reamer shown by FIG. 11 is part of a bottom hole assembly. It is located above the drill bit and is used to enlarge the diameter of the borehole. The reamer has a body 60 which carries a pair of pads 62. A mechanism within the body 60 can move these pads 62 between a retracted position 63 as shown at the left of FIG. 12 and an extended position 64 as shown at the right. Each pad 62 carries a number of PDC cutters 66 which face forwardly in the direction of rotation and also protrude from the pad 62 so as to project radially outwardly and thus cut into the wall of the borehole when the drill string is rotated with the pads 62 extended.

As shown by FIG. 13, the PDC cutters 66 on each pad 62 are arranged in groups above and below a smoother surface 67. They have polycrystalline diamond discs 44 at their forward faces. In this embodiment, protrusions which contain sensors and which may be similar to any of the protrusions 18 described above are positioned behind the PDC cutters at positions marked 68 on FIG. 13. The sensors in these protrusions 68 function in the manner described above with reference to FIGS. 3 and 4 and so can be used to detect when the PDC cutters 66 have been worn away by a predetermined amount.

Figure 14:
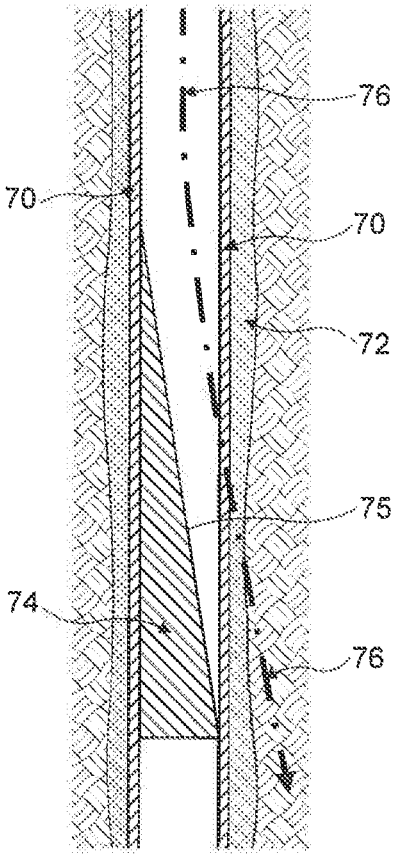
FIG. 14 schematically shows milling at the start of a sidetrack from a borehole.
Figure 15:
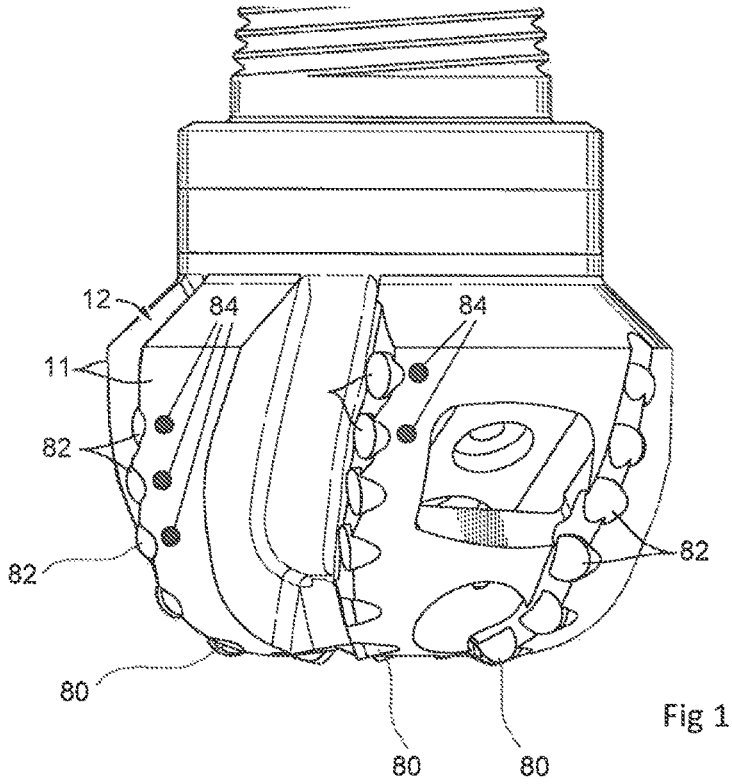
FIG. 15 shows a milling tool.

FIGS. 14 and 15 refer to the start of a sidetrack from an existing borehole by use of a window mill. FIG. 14 illustrates this schematically. The existing borehole is lined with steel casing 70 surrounded by cement 72. In order to start a new hole branching from the existing borehole, a whipstock 74 is first secured in the existing borehole. A drill string is run down the borehole and is forced sideways by the inclined surface 75 of the whipstock 74 so as to travel along the path shown by chain dotted line 76 and mill a window through the existing casing 70 and cement 72 and thereby start a new bore into the formation.

FIG. 15 shows an example of a milling tool used for this purpose. It has a main body on which there are blades 11 separated by channels 12, similarly to the drill bit of FIGS. 1 and 2. The body of the tool is steel. Attached to it by brazing are a number of cylindrical cutters. The cutters 80 on the leading end of the tool are PDC cutters. The cutters 82 on the sides of the tool have a longer period in contact with the steel casing 70 as the window through this casing is formed, and these cutters 82 are cylinders moulded from tungsten carbide and binder without any diamond face.

The tool is provided with protrusions as illustrated by any of FIGS. 5 to 9 at the positions indicated by circles 84. These protrusions follow behind the cutters 82 and contain a sensor for wear of these cutters as already explained above with reference to FIGS. 3 and 4. Protrusions with wear sensors are also provided at positions behind PDC cutters 80 but are not seen in FIG. 15.

Model Experiments

Figure 16:
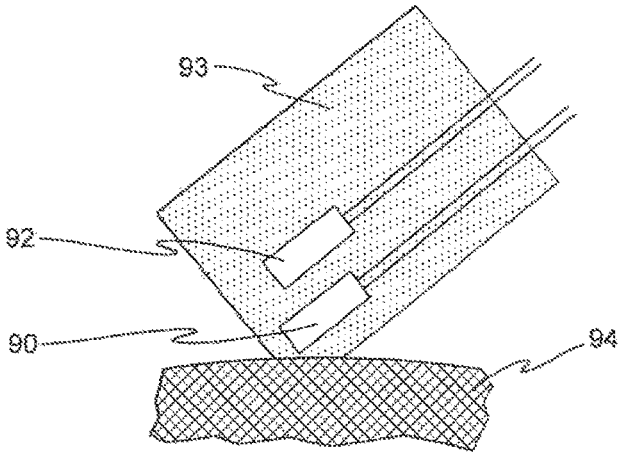
FIG. 16 shows apparatus used for an experimental test.
Figure 17:
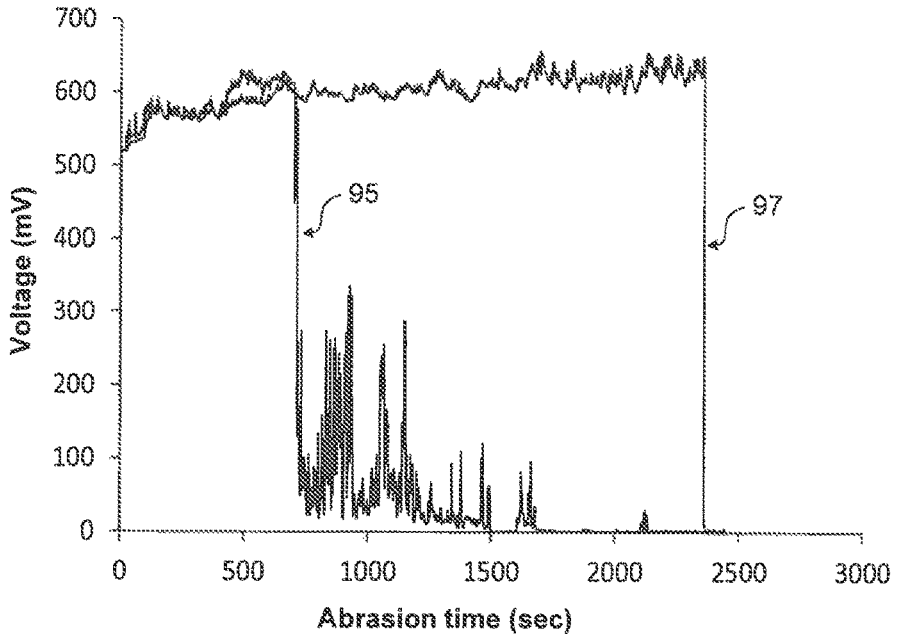
FIG. 17 is a plot of the results from a model experiment.

As shown by FIG. 16, two platinum resistance thermometers 90, 92 were positioned in holes drilled into a cylinder 93 of mild steel as a model for a protrusion 18 of the kind shown in FIG. 3. The platinum resistance thermometers 90, 92 were connected to separate channels of a data logger. The cylinder 93 was positioned at an angle as shown in FIG. 16 and worn down by grinding wheel 94. The voltages across thermometers 90 and 92 are shown as traces 95 and 97 respectively in FIG. 17 and it can be seen that they increased over time, indicating a rise in temperature and then fell to zero when the platinum wire was broken.

Figure 18:
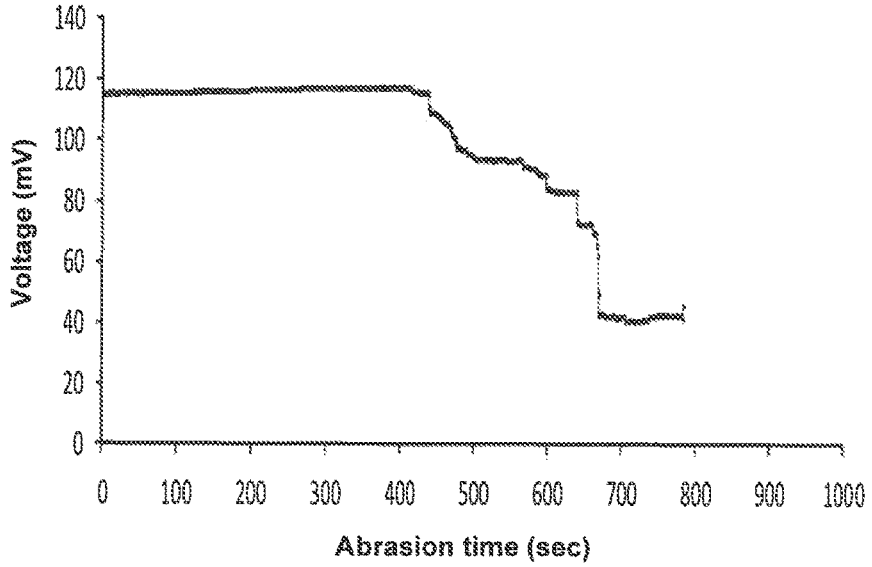
FIG. 18 is a plot of results from another model experiment.

FIG. 18 shows the result obtained using a glass optical fibre as a sensor. It was observed that only a small percentage of a light signal along an optical fibre was reflected back by a rough end, but much more of the signal was reflected back from a cleaved end to which a gold coating had been applied using a sputter coater. An optical fibre with such a coating on its end was used as a sensor in a hole drilled in a cylinder similar to the cylinder 93 in FIG. 16. This cylinder was abraded by a grinding wheel 94 as in FIG. 16. Light signals were directed along the fibre and the intensity of reflected signals as monitored by a photodiode is plotted in FIG. 18. As can be seen, the intensity of the reflected signal dropped after 500 seconds, as the end of the fibre was destroyed by the grinding wheel 94.

A cutting tool as disclosed herein may also be provided with additional sensors which monitor characteristics other than wear, for instance accelerometers or magnetometers. Data from such additional sensors may be communicated to the surface together with data from sensors in one or more protrusions, as disclosed above.

It will be appreciated that the example embodiments described in detail above can be modified and varied within the scope of the concepts which they exemplify. Features referred to above or shown in individual embodiments above may be used together in any combination as well as those which have been shown and described specifically. Accordingly, all such modifications are intended to be included within the scope of this disclosure as defined in the following claims.

The invention claimed is:

1. A rotary cutting tool for operation in a subterranean borehole, the tool comprising a support structure and a plurality of separate cutters attached to the support structure and protruding from the support structure toward the material to be cut by the tool, wherein the tool comprises:

an electrically operated sensor disposed at or coupled to a sensing point within a protrusion from the support structure, the protrusion being separate from the cutters; and an electronics package to communicate data from the sensor to the surface;

wherein the protrusion is located and dimensioned so as to extend from the support structure toward the material to be cut by the tool, but to follow behind one of the cutters as the tool rotates, to travel within a hole cut by one or more of the cutters of the tool, and to be shielded from contact with the material to be cut by the tool until attrition of at least one cutter reduces its size and brings the protrusion containing the sensing point into abrasive contact with the material to be cut by the tool;

wherein the sensing point is located in the protrusion such that attrition of at least one cutter to a predetermined partially worn state exposes the sensing point to the material that is being cut by the tool and thereby brings about a change in condition at the sensing point;

wherein the sensor is operative to detect the change at the sensing point.

2. The rotary cutting tool according to claim 1, wherein the protrusion containing the sensing point extends alongside a cutter.

3. The rotary cutting tool according to claim 1, wherein the protrusion containing the sensing point is spaced from the cutters.

4. The rotary cutting tool according to claim 1, wherein the sensor comprises at least one electrical conductor or optical fibre leading to the sensing point within the protrusion and is a sensor for damage to itself when the sensing point is exposed to the material that is being cut by the tool.

5. The rotary cutting tool according to claim 1, wherein the sensor comprises a temperature sensor at the sensing point.

6. The rotary cutting tool according to claim 1, wherein the tool comprises a plurality of electrically operated sensors, each sensor disposed at or coupled to a sensing point located within a plurality of protrusions extending from the support structure, and wherein each sensing point is located such that attrition of at least one cutter to a predetermined partially worn state exposes the sensing point to the material that is being cut by the tool.

7. The rotary cutting tool according to claim 1, wherein the tool comprises a plurality of sensors fitted at different locations on the tool and an electronics package for monitoring the sensors to observe the pattern of measurements by the sensors.

8. The rotary cutting tool according to claim 1, wherein the cutters are PDC cutters.

9. The rotary cutting tool according to claim 1, which is a drill bit, a reamer or a milling tool.

10. The rotary cutting tool according to claim 1, wherein the tool is a drill bit and the support structure is a body of the drill bit comprising tungsten carbide particles and a metal binder.

11. The rotary cutting tool according to claim 1, wherein the protrusion includes two sensors disposed at or coupled to different sensing points within the protrusion.

12. A method of monitoring the condition of a rotary cutting tool operating in a subterranean borehole, the tool comprising a support structure and a plurality of separate cutters attached to the support structure and protruding from the support structure toward the material to be cut by the tool, the method comprising:

providing the tool with an electrically operated sensor disposed at or coupled to a sensing point within a protrusion from the support structure, the protrusion being separate from the cutters;

operating the sensor to sense the condition at the sensing point; and communicating sensed information to the surface;

wherein the protrusion is located and dimensioned so as to extend from the support structure toward the material to be cut by the tool, but to follow behind one of the cutters as the tool rotates, to travel within a hole cut by one or more of the cutters of the tool, and to be shielded from contact with the material to be cut by the tool until attrition of at least one cutter reduces its size and brings the protrusion containing the sensing point into abrasive contact with the material to be cut by the tool;

wherein the sensing point is located in the protrusion such that attrition of at least one cutter to a predetermined partially worn state exposes the sensing point to the material which that is being cut by the tool and thereby brings about a change in condition at the sensing point.

13. The method according to claim 12, wherein the tool has a plurality of electrically operated sensors, each sensor disposed at or coupled to a sensing point located within a plurality of protrusions extending from the support structure, wherein each sensing point is located such that attrition of at least one cutter to a predetermined partially worn state exposes the sensing point to the material that is being cut by the tool, and wherein the method comprises observing a pattern of sensed information from the plurality of sensing points.

14. The method according to claim 12, wherein operation of the cutting tool at the subterranean location is one of:

drilling to extend a borehole, reaming to sustain or enlarge the diameter of a borehole, and milling to remove material placed within a borehole.

15. The method according to claim 12, wherein the sensor comprises at least one electrical conductor or optical fibre leading to the sensing point within each protrusion and the electrical conductor or optical fibre is a sensor for damage to itself when the sensing point is exposed to the material that is being cut by the tool.

16. The method according to claim 12, wherein the cutters are PDC cutters.

17. The method according to claim 12, wherein the cutting tool is a drill bit, a reamer, or a milling tool.

* * * * *